US005409222A

United States Patent [19]

Egging

[11] Patent Number: 5,409,222

[45] Date of Patent: Apr. 25, 1995

[54] AMUSEMENT DEVICE

[75] Inventor: Keith J. Egging, Itasca, Ill.

[73] Assignee: Electronic Arts Inc., San Mateo, Calif.

[21] Appl. No.: 139,844

[22] Filed: Oct. 22, 1993

[51] Int. Cl.[6] ..... A63F 7/00

[52] U.S. Cl. ..... 273/108; 273/118 R; 273/118 A; 273/119 A

[58] Field of Search ..... 273/108, 118 R, 118 A, 273/119 R, 119 A, 126 R, 126 A, 127 R, 129 R, 129 V, 142 R, 142 H

[56] References Cited

U.S. PATENT DOCUMENTS 3,797,828 3/1974 Ishikawa et al. .
3,825,265 7/1974 Pitkanen et al. .
4,004,807 1/1977 Leonhart .
4,598,910 7/1986 Halliburton ..... 273/119 A
4,971,323 11/1990 Gottlieb ..... 273/129 V
4,989,873 2/1991 Manabe ..... 273/142 R
5,090,699 2/1992 Friedman .
5,121,919 6/1992 Martti .

*Primary Examiner*—Raleigh W. Chiu
*Attorney, Agent, or Firm*—Patnaude, Videbeck, & Marsh

[57] ABSTRACT

An amusement device has an outer track forming a loop surounding a playing field, and is adapted to retain one or more play objects in motion around the outer track. An adjustable motor accelerates the play object within the track to a desired speed, and a lever directs the moving play object from the track to the play field.

6 Claims, 5 Drawing Sheets

AMUSEMENT DEVICE

The present invention relates to amusement devices, and in particular to amusement devices which use circular discs or spherical balls as play objects.

BACKGROUND OF THE INVENTION

Amusement devices wherein a circular disc or ball is projected into a playing field are well known in the art. Pinball machines and the like have spring operated launch mechanisms for injecting a ball into a playing field. A user of such a device can vary the speed of a ball by varying the compression applied to the spring of a launching mechanism. Although such mechanisms permit a player to vary the speed of the ball, they do not permit the player to observe the speed of the ball in motion, and adjust the speed prior to injecting it into the playing field.

SUMMARY OF THE INVENTION

Briefly, the present invention is embodied in an amusement device in which objects, typically circular discs or spherical balls, are projected into a playing field.

In accordance with the present invention, an outer track forming a loop surrounds the playing field, and is adapted to retain one or more play objects in motion around the outer track. The invention further includes a means for adjustably accelerating the play object within the track to a desired speed, and a means for directing a moving play object from the track into the play field.

In a preferred embodiment, the means for accelerating a play object include a motor for which the speed can be adjusted, the output shaft of which is connected to a drive wheel having an elastomeric outer surface. Where the play object is a circular disc of a given diameter or a sphere of a given diameter, the outer surface of the drive wheel is spaced a distance from the outer surface of the track which is not greater than the given diameter of the play object.

The invention also includes a means for deflecting a play object which is moving along the track, into the play field. The player of a game embodying the present invention can, therefore, affect the outcome of the game by adjusting the speed of the play object before it is deflected into the play field.

BRIEF DESCRIPTION OF THE DRAWINGS

A better understanding of the present invention can be had after a reading of the following detailed description taken in conjunction with the drawings wherein.

DETAILED DESCRIPTION OF THE PREFERRED EMBODIMENT

Figure 1:
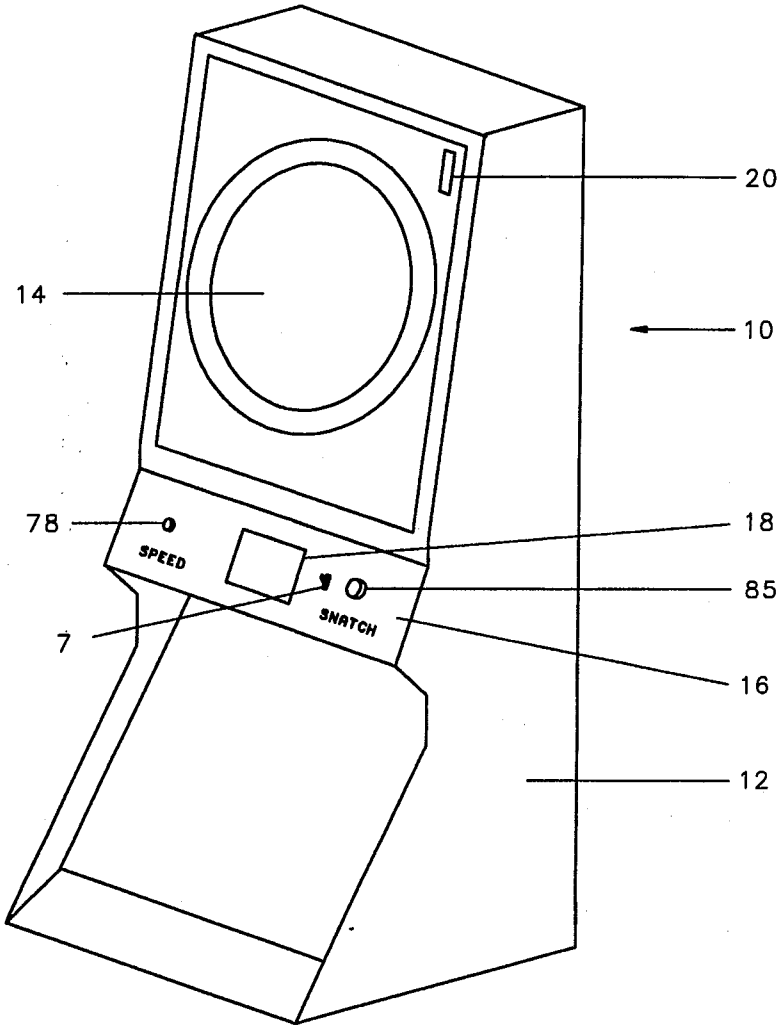
FIG. 1 is an isometric view of an amusement device embodying the present invention.
Figure 2:
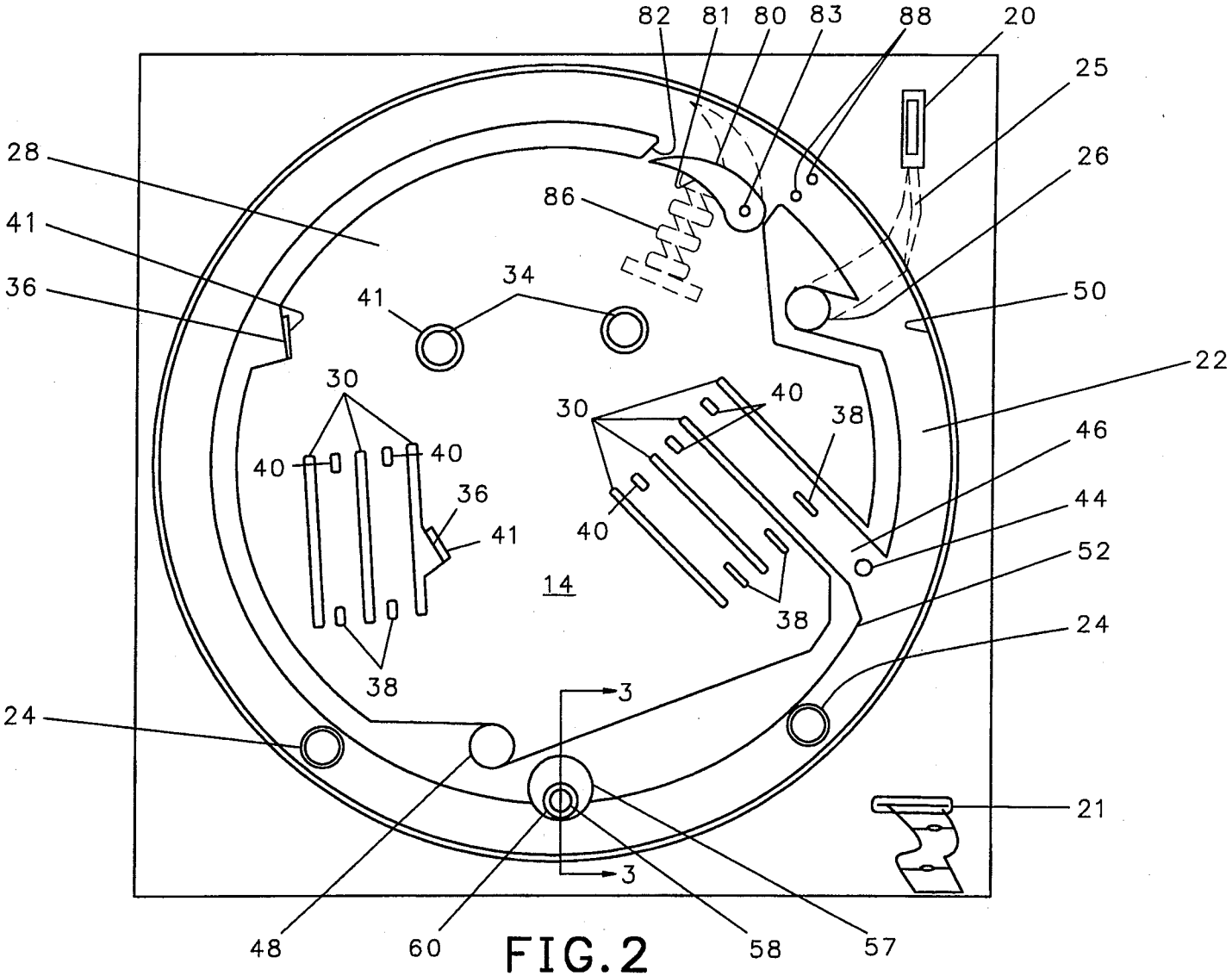
FIG. 2 is an enlarged view of the play field and track of the amusement device shown in FIG. 1 with portions thereof shown in phantom lines.

Referring to FIGS. 1 and 2, an amusement device 10 has a stand 12, a play field 14, a control panel 16, a time and score readout 18, and a coin acceptor 20. The device may also have a dispenser 21 for dispensing redemption tickets or, in the alternative, tokens or capsules or the like. Surrounding the play field 14 is a track 22 which is depicted in FIGS. 1 and 2 as being circular. Those skilled in the art will appreciate that the track 22 can be elliptical or any shape which does not have corners or sharp turns which will slow the movement of a play object along a track 22.

In the preferred embodiment, the amusement device 10 is adapted to utilize a plurality of circular discs as the play objects 24. The circular discs 24 may be quarters or other coins which are received in the acceptor 20, slide along a track 25, and enter through a port 26 positioned inside of the track 22. The play field 14 may be oriented so as to be nearly horizontal, or vertical, or at an intermediate angle as shown in FIG. 1. The play field should not be horizontal because the force of gravity is a factor in causing the play objects to move across the play field to an exit or collector at the lowest elevation thereof as described below. If a coin, such as a quarter, is to be used as the play object 24, the coin acceptor 20 and the track leading to the port 26, and from the port 26 into the track 22, should be oriented such that the force of gravity will draw the coin through the track 25 to the port 26 and into the track 22.

Figure 8:
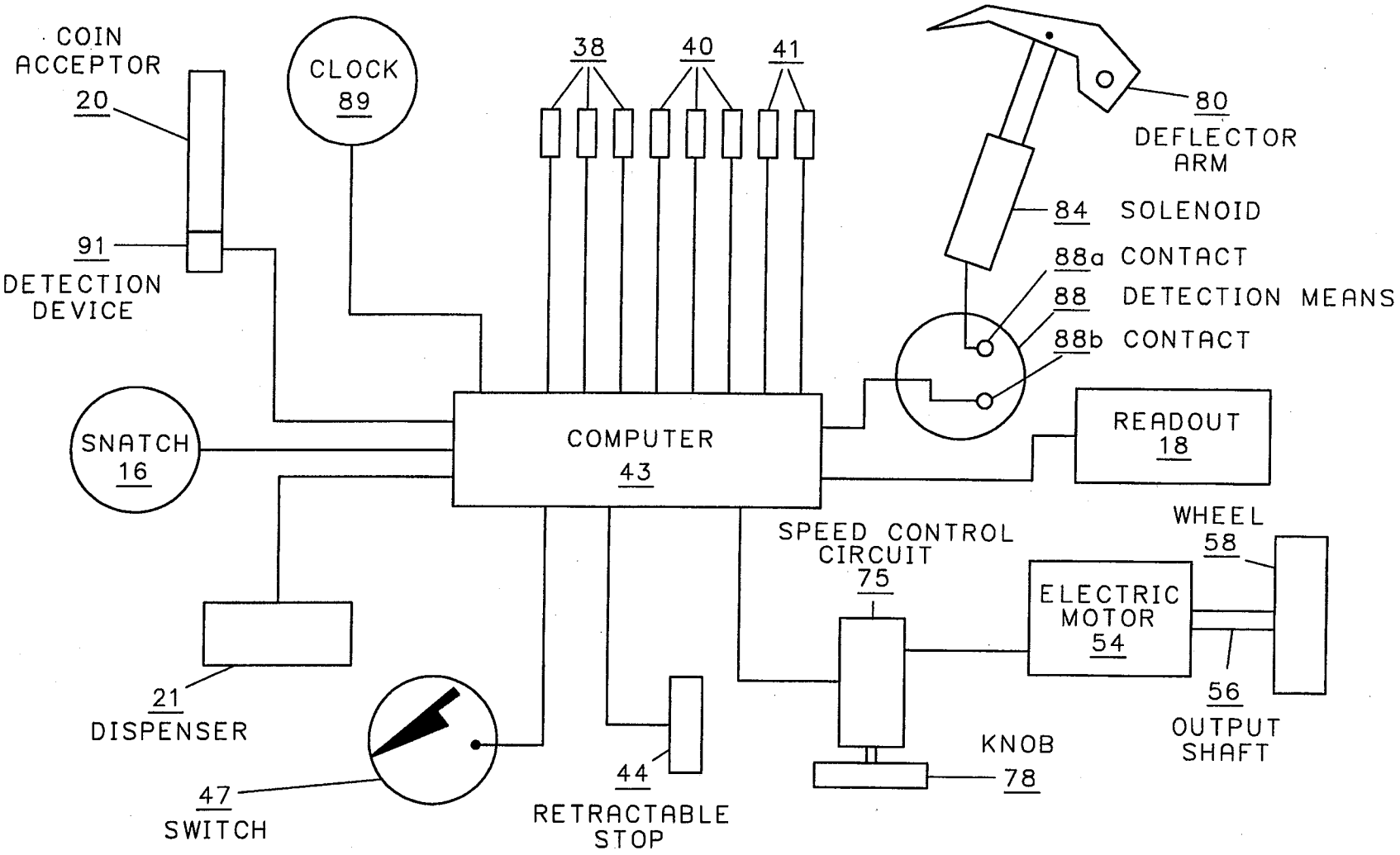
FIG. 8 is a block diagram of the circuit for the device shown in FIG. 1.

Referring to FIG. 2, the playing field 14 has a substantially planar back panel 28 upon which a plurality of parallel partitions 30—30 are positioned and which are spaced apart a distance which is a little greater than the diameter of the play object 24. The play field also includes a plurality of obstacles 34 and planar surfaces 36 which are perpendicular to the back panel 28 of the play field 14. The planar surfaces 36 and the obstacles 34 are adapted to be stricken by moving play objects 24. It is the intent of a player of the amusement device 10 to direct rapidly moving play objects 24 into the play field 14 from the outer track 22, and to cause the play objects 24 to encounter the obstacles 34 and surfaces 36 and to fall into desired channels formed by the partitions 30—30. The play objects may be collected and retained by solenoid operated retractable stops 38, and the number of play objects 24 which pass between parallel partitions 30—30 may be counted by detection devices 40 positioned within the channel. The retractable stops 38 can be withdrawn by the computer 43 to release all play objects 25 collected in the channels between partitions 30—30 at the conclusion of the game or prior to commencement of a new game. As shown in FIG. 8, covering the play field 14 and the surrounding track 22 is a transparent planar lens 42 which is positioned substantially parallel to the lower panel 28, and sufficiently distant from the lower panel 28 so as to not interfere with the movement of a play object 24 within the track 22, or within the play field 14.

Referring to FIGS. 2 and 8, the obstacles 34 and the surfaces 36 may also incorporate electronic switches 41 which are actuated when a play object 24 has contacted the associated obstacle 34 or surface 36. The signals from the switches 41 on the obstacles 34, and surfaces 36 and from the detection devices 40 are tabulated by a computer 43 and displayed on the readout 18 as a score which reflects the players performance of the amusement device 10.

Figure 3:
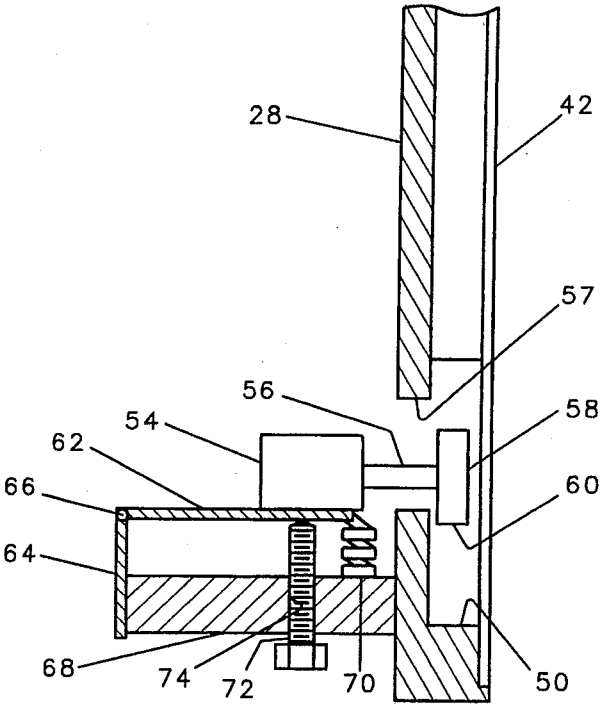
FIG. 3 is a fragmentary cross-sectional view of the amusement device shown in FIG. 1, taken through lines 3—3 of FIG. 2.

Referring further to FIGS. 2 and 3, the track 22 has an outer surface 50 against which the play objects 24 can roll, and an inner wall 52. The inner wall 52 is spaced a distance from the outer surface 50 which is greater than the diameter of the play objects 24 such that the play objects 24 may readily roll around the outer surface 50 of the outer track 22 without contact against the inner wall 52.

One channel 46 formed by the partitions 30—30 also having a solenoid operated retractable stop 44 is positioned near an opening in the inner wall 52 of the track 22. Play objects 24 which fall within channels 46 will re-enter the outer track 22 when the retractable stop 44 is withdrawn in response to signal received from a switch 47 on the control panel 16. The play field 14 further includes an exit port 48 positioned at the lowest point on the play field 14 through which play objects 24, which have completed their circuit through the play field 14, may be withdrawn and collected in a coin box or the like, not shown.

To accelerate a play object 24 around the loop of the track 22, a means for accelerating the play object 24 is provided at a low portion of the track 22. The means for accelerating includes a variable speed electric motor 54 the output shaft 56 of which is generally perpendicular to the back panel 28 and extends through a hole 57 in the back panel 28. Attached to the output shaft 56 is a wheel 58 having an elastomeric outer surface 60. The electric motor 54 is attached by any suitable means such as screws, not shown, to a mounting plate 62 which extends rearward of the motor 54, and the rearward end of the mounting plate 62 is attached to a support arm 64 by a transverse hinge 66. The support arm 64 is attached to a substantially planar mounting member 68 which depends perpendicularly below the under surface of the back panel 28, such that the motor 54 and the wheel 58 pivot around the hinge 66. The outer surface 60 of the wheel 58 will move toward or away from the outer surface 50 of the outer track 22. A spring 70 connected between the mounting member 68 and the mounting plate 62 is adapted to draw the mounting plate 62 toward the mounting member 68 and, therefore, urge the wheel 58 toward the outer surface 50 of the track 22. A threaded adjusting screw 72 is fitted into a complementary threaded transverse hole 74 in the mounting member 68 positioned adjacent the motor 54, for adjusting the distance of the surface 60 of the wheel 58 from the outer surface 50 of the track 22. The mounting plate 62 with the motor 54 attached thereto will be drawn by the spring 70 to contact the distal end of the adjusting screw 72. The adjusting screw 72 should be set such that the distance between the outer surface 60 of the wheel 58 and the outer surface 50 of the track 22 is a little less than the diameter of a play object 24.

A play object 24 which enters the track 22 from a port 26 will be drawn by gravity to the lower portion of the track 22 where the motor 54 is positioned. The play object 24 will then move under the rotating wheel 58 driven by the motor 54 and the elastomeric surface 60 of the wheel 58 will apply rotational movement to the play object 24. The play object 24 will be immediately accelerated and caused to move around the track 22 at a speed which is directly proportional to the speed of the motor 54. Typically, the play objects may be caused to move around the track 22 at a relatively slow speed, for example, one revolution around the track per second, to a relatively fast speed whereby a play object may traverse twenty or more revolutions of the track 22 in one second.

Referring to FIG. 8, the motor 54 may be a DC or AC and the speed of the motor controlled by an appropriate speed control circuit 75 as are well known in the art. The speed control circuit 75 includes a control element having a rotatable shaft, not shown, extending through the control panel 16 with a rotatable knob 78 attached at the distal end thereof. Rotation of the knob 78 will adjust the speed of the motor 54, and the speed of play objects 24 which are accelerated by the motor 54 and move around the track 22.

The control panel 16 can have a pair of buttons, not shown, of one of the buttons adapted to cause the speed of the electric motor to increase when it is depressed, and the other of the buttons adapted to cause the speed of the electric motor to decrease when it is depressed.

Referring to FIG. 2, a play object 24, which is rotating around the loop of the track 22, can be deflected into the playing field 14 by a deflecting means such as a deflector arm 80 having an arcuate inner surface 81. The deflector arm 80 is fitted into a gap 82 through the inner wall 52 of the track 22 forming a passage between the track 22 and the play field 14. The deflector arm 80 is pivoted about a transverse pin 83 at one end thereof and moves from a first position wherein the arm 80 does not extend into the track 22 as shown in solid lines in FIG. 2 to a second position wherein the arm 80 extends against the outer wall 50 of the track 22 as shown in phantom lines in FIG. 2. The arm 80 is retained from extending into the track 22 by a spring 86 and drawn into the position shown in phantom lines in FIG. 2 by a solenoid 84, shown in FIG. 8, which is energized by depressing a "snatch" button 85 on the control panel 16.

Upon depressing the "snatch" button 85 on the control panel 16, the solenoid 84 will cause the deflector arm 80 to rotate about the pin 83 to the position shown in phantom lines in FIG. 2 and thereby opening the passage between the track 22 and the play field 14. When the deflector arm 80 is rotated to the position shown in phantom lines in FIG. 2, a play object 24 moving within the track 22 will encounter the arcuate surface 81 of the deflector arm 80 and be deflected and pass through a gap 82 and enter the playing field 14.

Referring to FIGS. 2 and 8, to avoid the deflector arm 80 contacting a moving playing object 24 while the arm 80 is pivoting to its deflecting orientation, the invention also includes a detection means 88 in the track 22 near the deflector arm 80 positioned such that it will be actuated after a moving play object has passed the detection means 88. Where the play object is a metallic coin, the detection means 88 consists of two adjacent electrical contacts 88A, 88B embedded into the lower panel 28. When a metallic coin passes over the contacts of the detection means 88, the resistance between the contacts is reduced, sending a signal to the computer 43 that a coin has passed by the deflector arm 80. When the "snatch" button 85 is depressed, the computer will direct power to the solenoid 84 immediately after the detection device 88 indicates a coin has passed the deflector arm 80, thereby preventing a jamming of the deflector arm 80 against a moving play object. Once the solenoid 84 is activated, power will continue to be applied to the solenoid 84 until the "snatch" button is released by the player enabling the player to cause one or more play objects moving in the track 22 to be deflected into the play field 14.

A clock 89, or the like, may also be incorporated into the amusement device 10 such that a player will forfeit his game or suffer a penalty if he does not cause the play objects to be deflected into the play field 14 within a predetermined period of time.

Referring to FIG. 8, the game is initiated when a play object 24, such as a coin, is deposited in the receptor 20. The receptor 20 also includes a detection device 91 which signals the computer 43 that the game has started and releases all accumulated play objects 24 retained by stops 38. The computer 43 also starts the clock 89 and initiates power to the speed control 75 and motor 54. The play object 24 then passes through port 26 and enters the track 22 where it can be accelerated by the rotating wheel 58 and causing the play object 24 to rotate around the track 22. The player can adjust the speed at which the play object 24 moves around the track 22 by adjusting the control knob 78, and thereby regulating the speed of the motor 54 and the wheel 58. When the player is satisfied that the play object 24 is moving at the desired speed, he may depress and hold down the snatch button 16. After the play object 24 thereafter passes across the detector 88, the solenoid 84 will be actuated and the arm 80 pivoted from the solid line position shown in FIG. 2 to the phantom line position. In the meantime, the play object 24 will continue its movement around the track 22, pass under the wheel 58, and eventually encounter the arcuate surface 81 of the arm 80 and be deflected into the playing field 14.

Within the playing field 14, the play object 24 may hit various detectors 41 and slide between partitions 30—30 so as to actuate switches 40. Signals received from the switches will be tabulated by the computer 43 and the total score shown in the readout 18.

In the event the player fails to depress the snatch button 18 within a certain time, the clock 89 will notify the computer 43 to automatically operate the solenoid 84 and move the arm 80 to the position shown in phantom lines in FIG. 2. The switch 47 which retracts the stop 44 and allows play objects which have accumulated in channel 46 to re-enter the track 22 can be operated by the player. If, however, the player fails to release the stop 44 within a predetermined interval of time, as determined by the clock 89, the computer 43 will then withdraw the stop and release all play objects 24 collected in channel 46, and thereby set a maximum playing time of the game. At the end of the game, the dispenser 21 can be signalled to emit tickets, tokens or other rewards commensurate the the player's skill as determined by the readout 18.

Figure 4:
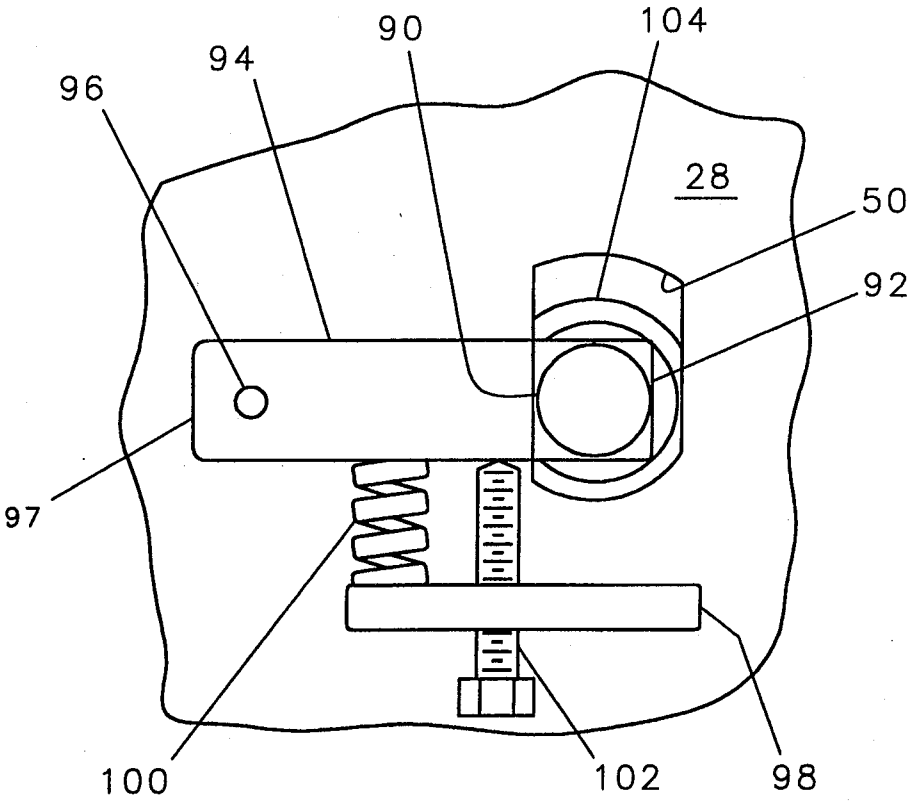
FIG. 4 is a rear view of an alternate embodiment for mounting of a motor and drive wheel in an amusement device similar to that shown in FIG. 1.

An alternate embodiment of a mounting for a motor is shown in FIG. 4. In this embodiment, a motor 90 is attached to a first end 92 of a pivot arm 94 by a plurality of bolts or the like, not shown. The pivot arm 94 rotates about a pivot pin 96 at a second end 97 thereof and the axis of the pivot pin 96 is parallel to the axis of the drive shaft of the motor 90. The pin extends into a transverse hole, not shown, which passes perpendicularly into the back panel 28. Adjacent the pivot arm 94 and spaced a short distance therefrom is a reference plate 98 which depends from the under surface of the back panel 28. A spring 100 is joined at one end to the reference plate 98 and at the other end to the motor end 92 of the pivot arm 94 and the spring 100 draws the motor end 92 thereof toward the reference plate 98. An adjustable screw 102 extends through a threaded hole, not shown, in the reference plate 98 and the distal end of the adjusting screw 102 abuts against the motor end 92 of the pivot arm 94. As in the prior embodiment, rotation of the screw 102 will result in the wheel 104 attached to the end of the shaft of the motor 90 moving toward or away from the outer surface 50 of the track 22.

Figure 5:
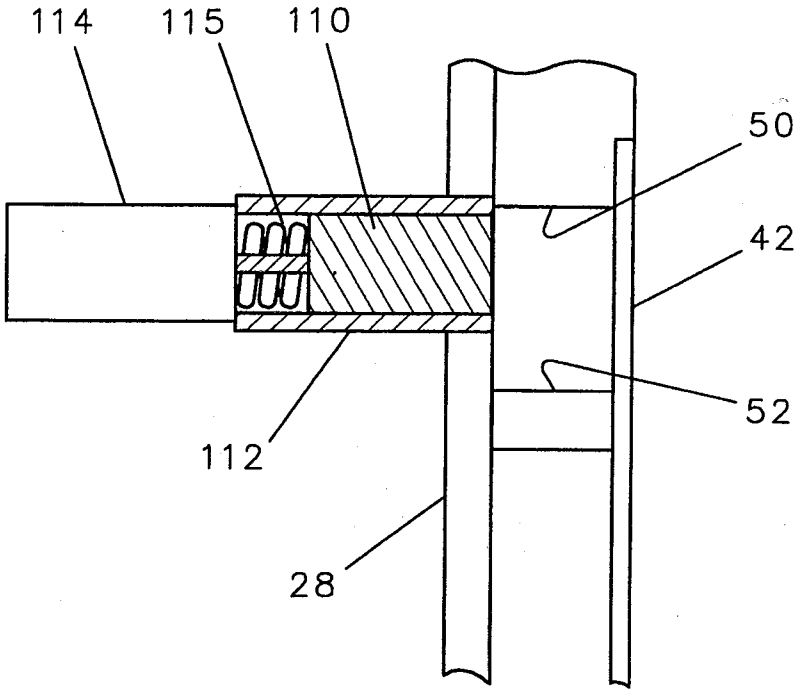
FIG. 5 is an enlarged cross-sectional view of an alternate embodiment for a mechanism having a deflecting piston to deflect a play object from the track and into the play field of an amusement device similar to that shown in FIG. 1 with the piston shown in the withdrawn position.
Figure 7:
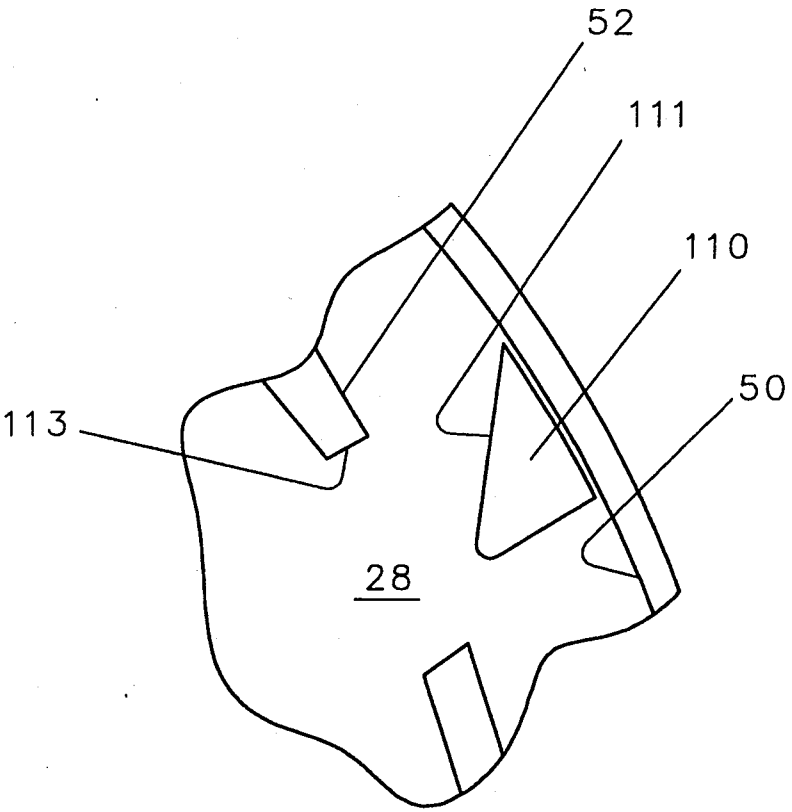
FIG. 7 is an enlarged fragmentary top view of the mechanism shown in FIG. 5 for deflecting a play object from the track.
Figure 6:
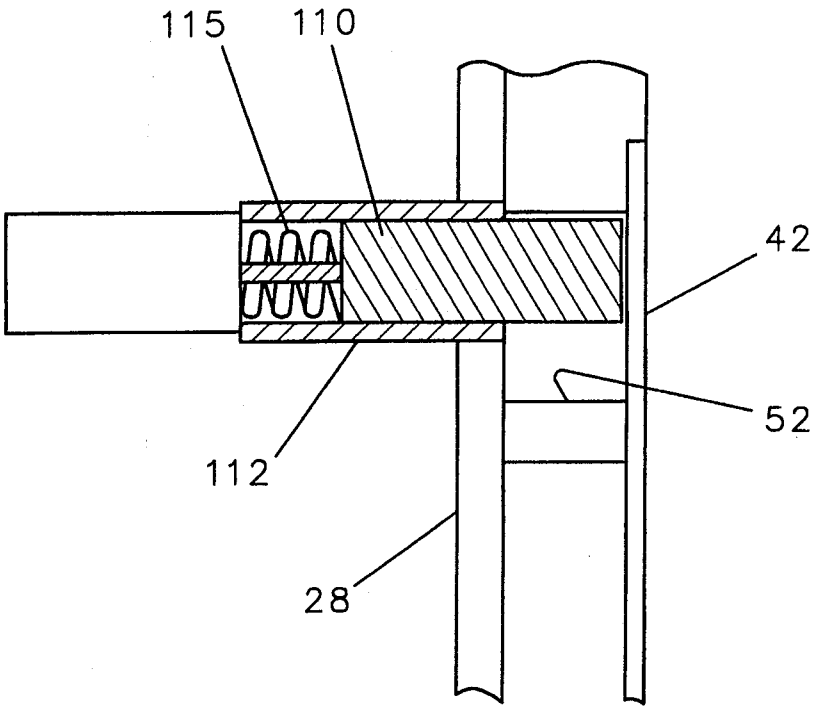
FIG. 6 is an enlarged fragmentary cross-sectional view of the mechanism shown in FIG. 5 for deflecting a play object from the track with the piston shown in the extended position.

Referring to FIGS. 5, 6 and 7 an alternate embodiment of a means for deflecting a playing object is shown. In this embodiment, a wedge shaped pin 110 having a ramp surface 111 is slidably received into sleeve 112 which depends below the under surface of the back panel 28. When the pin 110 extends outward from the sleeve 112, it will project along the outer surface 50 of the track 22, and a playing object 24 moving along the track 22 will be deflected along the ramp surface 111 of the pin 110. A gap 113 in the inner wall 52 separating the track 22 from the play field is sized and positioned to permit play objects 24 deflected by the ramp of the pin 110 to enter the play field 14. A solenoid 114 and a spring 115, or other mechanism known in the art, may be used to control movement of the pin from its retracted position as shown in FIG. 5 or to its extended position as shown in FIG. 6.

In the foregoing embodiments, the play object 24 is depicted as being a circular disc, or a coin, however, spherically shaped paying objects, or egg shaped playing objects may also be used with the present invention. Furthermore, although the play objects 24 are depicted as constructed of rigid material such as metal, it is not necessary that the playing objects be rigid. The playing objects could readily be a plurality of flexible balls. Where the playing objects are flexible balls, the outer surface 60 of the wheel 58 need not be elastomeric, but may be steel without detracting from the effectiveness of the invention.

There is, therefore, disclosed an amusement device 10 in which a player may control the speed at which the play objects 24 move around the outer track 22, and when the player is satisfied that the play objects are moving at a desired speed, the deflecting device can be actuated and one or more play objects deflected into the play field 14.

While the present invention has been described in connection with several embodiments, it will be understood by those skilled in the art that many changes and modifications may be made within the true spirit and scope of the invention. Therefore, it is intended by the appended claims to cover all such changes and modifications which come within the true spirit and scope of the invention.

What is claimed:

1. An amusement device comprising in combination:

a track forming a closed loop around which a play object having a given diameter is movable, said track having an inner wall means extending along a portion of said loop for retaining a play object within said track, means for accelerating a play object around said track, a play field within said track, defining a plane and said plane of said play field not horizontal and means for deflecting a play object which moving in said track through an opening in said inner wall means and into said play field.

2. An amusement device in accordance with claim 1 further comprising:

said track having an outer surface, said means for accelerating a play object comprising a variable speed motor and a drive wheel having an outer surface, said outer surface of said drive wheel spaced a distance from said outer surface of said track which is not greater than said given diameter of a play object for accelerating a play object passing between said drive wheel and said outer surface of said track.

3. An amusement device in accordance with claim 1 wherein said means for deflecting a play object comprises a deflecting arm pivotally mounted on one end thereof so as to pivot into said track.

4. An amusement device in accordance with claim 1 wherein said means for deflecting a play object comprises an elongate pin and, said pin longitudinally movable from a retracted position to an extended position for deflecting a play object when in the extended position.

5. An amusement device in accordance with claim 1 further comprising:

detection means for detecting that a play object is near said means for deflecting for determining that a play object has passed said means for deflecting and will not interfere with the movement of said means for deflecting.

6. An amusement device comprising in combination:

a track forming a closed loop around which a play object having a given diameter is movable, said track having a portion thereof elevated relative to another portion thereof, means for accelerating a play object around said track to a substantially constant speed, a play field within said track, inner wall means for retaining a play object within said track and out of said play field, and means for deflecting a play object which is moving in said track across said inner wall means and into said play field.

* * * * *